United States Patent [19]

McCambridge

[11] Patent Number: 4,654,926

[45] Date of Patent: Apr. 7, 1987

[54] VACUUM CLEANER

[75] Inventor: James McCambridge, Polo, Ill.

[73] Assignee: Central Quality Industries, Inc., Polo, Ill.

[21] Appl. No.: 721,061

[22] Filed: Apr. 8, 1985

[51] Int. Cl.[4] ..... A47L 9/00

[52] U.S. Cl. ..... 15/327 D; 15/328; 15/353; 15/413

[58] Field of Search ..... 15/327 R, 327 D, 352, 15/353, 413, 347, 328

[56] References Cited

U.S. PATENT DOCUMENTS

| | | | |
|---|---|---|---|
| 1,316,442 | 9/1919 | Goughnour | 15/353 X |
| 2,233,167 | 2/1941 | Holm-Hansen | 15/353 |
| 3,618,297 | 11/1971 | Hamrick | 15/314 X |
| 3,775,951 | 12/1973 | Eicholz et al. | 55/417 |
| 4,569,100 | 2/1986 | Purkapile | 15/327 D X |

*Primary Examiner*—Chris K. Moore

*Attorney, Agent, or Firm*—Wood, Dalton, Phillips, Mason & Rowe

[57] ABSTRACT

According to the invention, a canister with bottom and peripheral walls defines an accumulation space for matter picked up by the vacuum. A lid is secured to the upper edge of the canister and seals the space. The invention resides in the provision of a canister extension whose bottom edge conforms to the top edge of the canister and bears thereupon. The extension can be secured to the canister permanently or removably in any known manner, as by sonic welding or the like. The lid in turn mates with the extension in the same manner that it mates with the open canister edge. Accordingly, the canister capacity is increased. Any number of such extensions can be employed depending upon the range of capacity sought. The invention also contemplates providing a plate bounding an impeller chamber that can be inverted to selectively accommodate different capacity impellers and different capacity motors.

6 Claims, 7 Drawing Figures

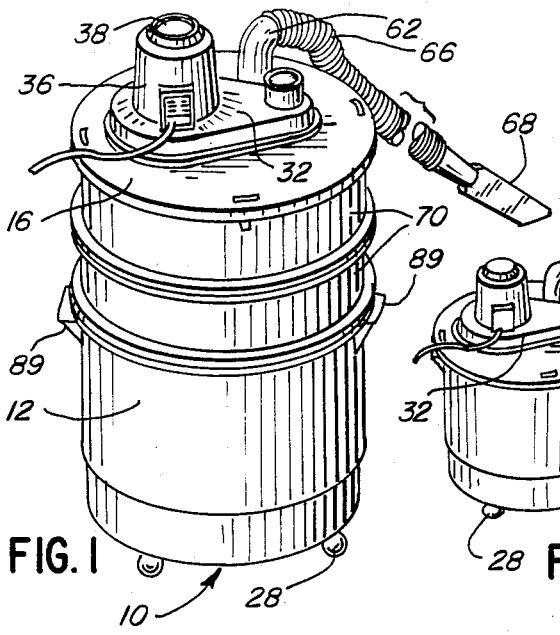
FIG. 1
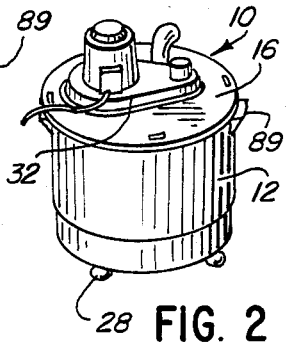
FIG. 2
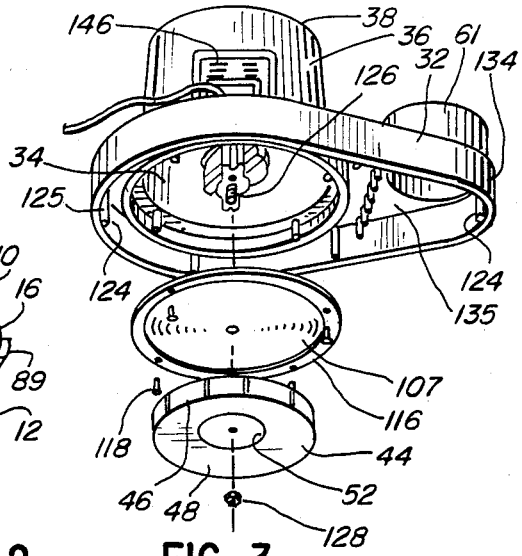
FIG. 3
FIG. 4
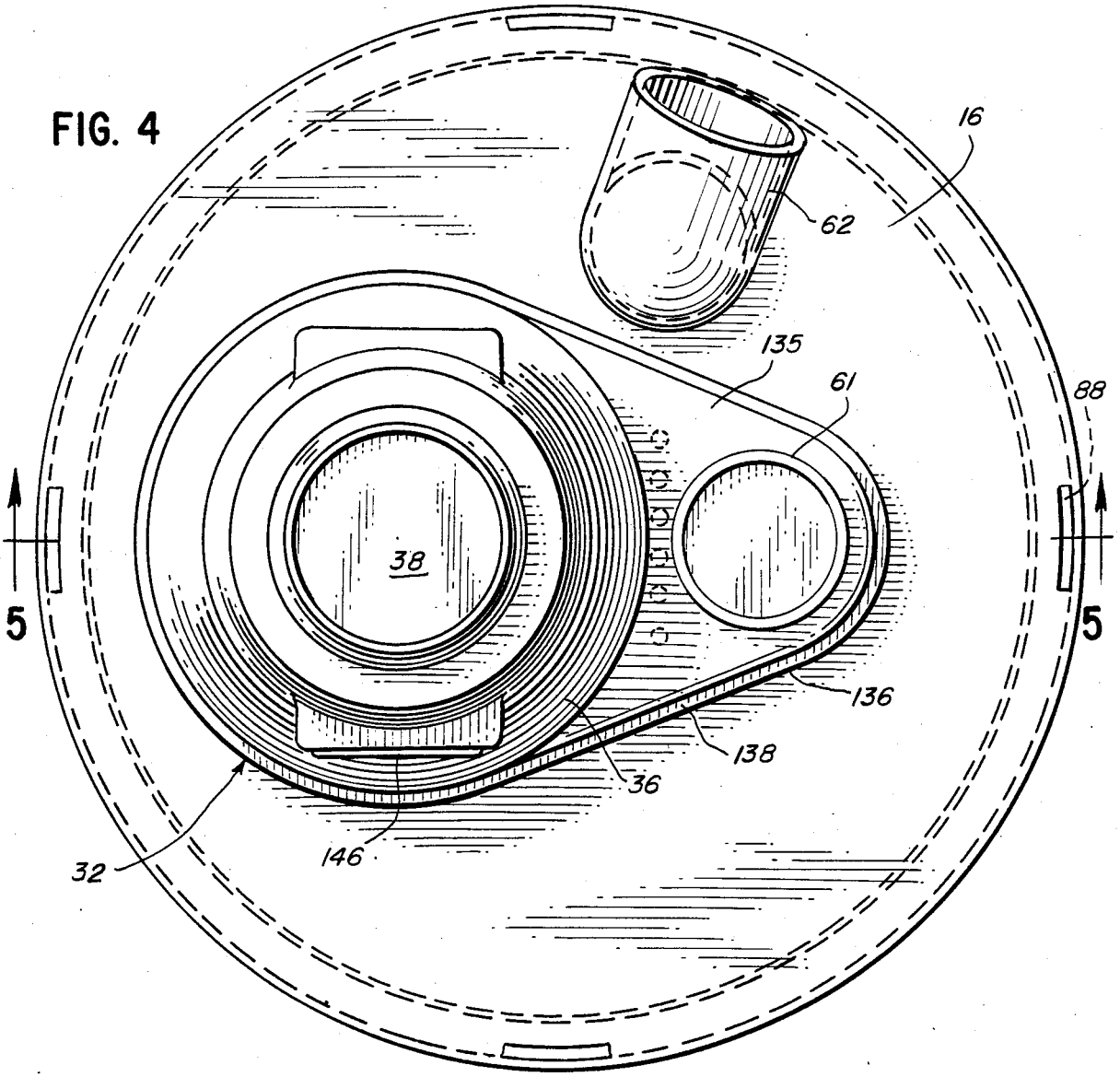

VACUUM CLEANER

BACKGROUND OF THE INVENTION

1. Field of the Invention

This invention relates to canister style vacuum cleaners and, more particularly, to a vacuum cleaner with selectable canister size and impeller capacity.

2. Background Art

A conventional vacuum cleaner has a canister with an associated lid to define an accumulation space for matter such as particulate and/or liquids. A motor driven impeller evacuates the canister to develop suction in a flexible hose or the like connected at an inlet communicating with the inside of the canister. The capacity of the impeller is chosen depending upon the air volume within the canister, or air flow desired.

It has heretofore been common in the vacuum cleaner art to have fixed capacity evacuating structure and canisters. Consequently, a supplier would necessarily stock distinct units of different capacity. The evacuating structure and the canisters would not be interchangeable from one capacity unit to the next. Consequently, the units would of necessity be separately manufactured and inventoried. This represents a substantial inconvenience from both manufacturing and supply ends.

A further drawback with the prior art vacuum cleaners is that they are normally complicated to construct. For example, often the canister has a lid with separately attached walls and dividers interconnected to define separate chambers. An evacuation chamber might have separately attached hose fittings at an intake and might be separate from a housing containing the operating motor. Not only is the assembly complicated, but the costs attendent thereto must necessarily increase proportionately. The likelihood of malfunction increases with the number of parts.

A still further problem that has been contended with in the art is the problem of overheating of the operating motor carrying the impeller. Normally, the motor is supplied as a self-contained unit and is carried in a cavity associated with a housing attached to the canister lid. The structure does not lend itself to adequate ventilation and it may be difficult to force air over the cased motor to effect sufficient cooling to safely operate the motor.

The present invention is specifically directed to overcoming the above enumerated problems in a novel and simple manner.

SUMMARY OF THE INVENTION

According to the invention, a canister with a bottom and peripheral wall defines an accumulation space for matter to be picked up by vacuum. A lid is secured to the upper edge of the canister to seal the accumulation space. The invention resides in the provision of a canister extension whose bottom edge conforms to the top edge of the canister and bears thereupon. The extension can be secured mechanically in any known manner, as by sonic welding or the like to the canister. The lid in turn mates removably with the extension in the same manner that it would mate with the open canister edge. Accordingly, the canister capacity is increased. Any number of such extensions can be employed depending upon the range of capacity sought.

Normally, the evacuating structure comprises a motor mounted in a cavity associated with a housing carried by the lid. The motor moves the impeller in a chamber bounded in part by a flat surface associated with the lid and a flat upper surface associated with the housing. To most efficiently maximize operation of the impeller, the impeller is closely received between the spaced, flat surfaces associated with the lid and housing.

To accommodate a change in canister capacity or power level required, the invention contemplates that the impeller associated with the evacuating structure be readily interchangeable. According to the invention, the housing surface is defined by a removable plate having a flat body and a rim offset by a ring from the plane of the body for mounting the plate with the housing. The plate can be placed selectively in either a first position wherein one oppositely facing surface of the flat body bounds the impeller chamber and a second position wherein the other of the oppositely facing flat surfaces of the body bounds the chamber. Due to the offset nature of the rim, and to that extent, the dimension of the chamber is adjustable. Different capacity impellers can be used depending upon which position the plate is in. Conversion between different operating capacities for the evacuation structure involves merely removing the impeller, inverting the plate and replacing the impeller with one of different capacity.

The top chamber of the motor housing is also designed to accept large height motors depending on the power level required. High and low capacity motors are readily interchangeable in the lid housing. To compensate for inversion of the plate to the low capacity mode, the entire motor is shiftable downwardly to maintain the same relationship between the motor and the plate surface facing away from the impeller. The low capacity motor, even if it is axially shorter than the substituted for high capacity motor, is effectively accepted in the lid housing.

A still further aspect of the invention is formation of the motor-carrying housing by injection molding. Integrally formed with the housing are a cavity for the motor, an exhaust fitting, an impeller chamber and a housing portion that surrounds at least part of either a low capacity or high capacity motor and directs ambient air over the motor to effect cooling. The need for a full housing about the motor is obviated by the housing construction of the present invention.

BRIEF DESCRIPTION OF THE DRAWINGS

FIG. 1 is a perspective view of a canister style vacuum cleaner with two canister extensions according to the present invention incorporated therein;

FIG. 2 is a perspective view of the vacuum cleaner of FIG. 1 without any extensions incorporated therein;

FIG. 3 is an enlarged, exploded, perspective view of evacuating structure for the vacuum cleaner of FIGS. 1 and 2 according to the present invention;

FIG. 4 is an enlarged, plan view of the vacuum cleaner of FIGS. 1 and 2;

DETAILED DESCRIPTION OF THE DRAWINGS

Figure 5:
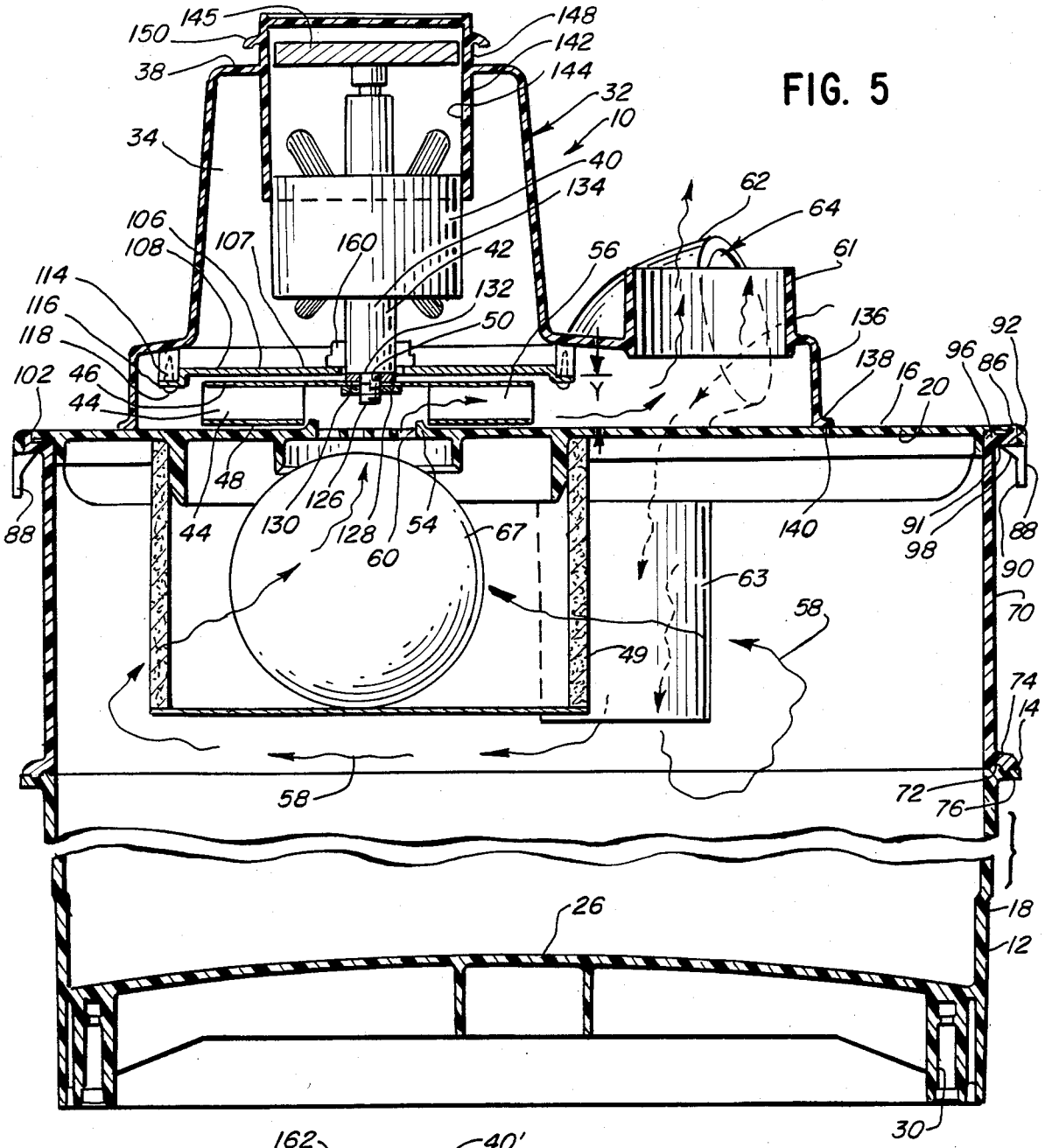
FIG. 5 is a section view of the vacuum cleaner along line 5—5 of FIG. 4 with the evacuating structure in a first operating mode.

The invention is incorporated preferably into a canister style vacuum cleaner of the type shown generally at 10 in FIGS. 2 and 5. The vacuum cleaner 10 comprises a cylindrical canister 12 that has an upwardly opening, cup shape and an upper edge 14 sealed by a disc-shaped lid 16. The peripheral wall 18 of the canister 12, the underside 20 of the lid 16 and a bottom wall 22 cooperatively bound a space 24 for the accumulation of matter that is picked up by vacuum. The bottom wall 22 slopes away from its center 26 downwardly as it converges towards the peripheral wall 18. The configuration of the bottom wall 22 is such that it directs solid and liquid matter gravitationally away from the center 26 so that it does not mound or accumulate in a pool in the center of the canister. The entire canister 12 is preferably molded as a single piece from durable plastic. To enhance the maneuverability of the vacuum cleaner 10, casters 28 are provided and are snap-fit into sockets 30 molded integrally in the bottom of the canister 12.

Figure 6:
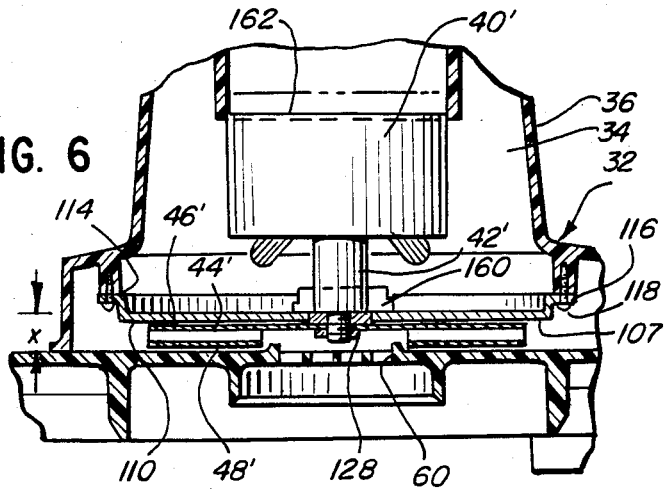
FIG. 6 is a fragmentary, section view of the evacuating structure of FIG. 5 in a second operating mode.
Figure 7:
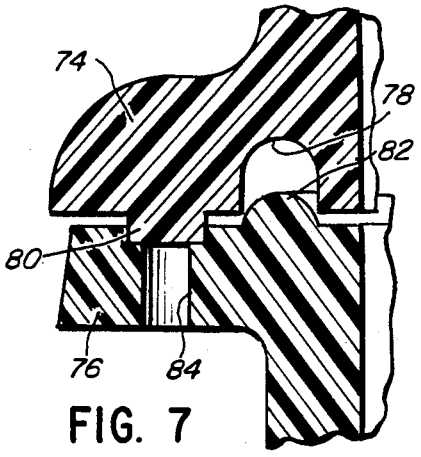
FIG. 7 is an enlarged, fragmentary, sectional view of the connection between the upper edge of the canister and the lower edge of the canister extension.

As seen in FIGS. 1–5, the lid 16 supports evacuating structure and particularly an integrally formed housing at 32 which has a cavity 34 formed by a peripheral wall 36 and an integral top wall 38 cooperatively defining an inverted cup shape. Electrically operated, high speed motor 40 (FIG. 1) and low speed motor 40' (FIG. 6) reside in the cavity 34 and have shafts 42, 42' carrying impellers 44 (FIG. 5) or 44' (FIG. 6). The impellers comprise spaced, parallel discs 46, 46', 48, 48' with vertical, aligned axes. High speed impeller 44 will be described below. Its structure and operation exemplifies the structure and operation of the low speed impeller 44'. The upper disc 46 has an opening 50 to admit the end of the shaft 42 and the lower disc 48 has an enlarged opening 52 seating closely over an upstanding, annular rim 54 formed integrally with the lid 16 and surrounding an opening 60 in the lid. A plurality of substantially radially directed vanes 56 are located between and attached to the discs 46, 48, maintain the spacing between the discs 46, 48, and attack the air as the impeller is rotated, centrifugally propelling the air intercepted and thereby creating a suction in the space 24 in the cannister. A cylindrical filter member 49 is friction fit on the outer periphery of depending sleeve 51 which sleeve is integrally formed on the lower surface of lid 16 and is symetrical about the opening 60 in said lid. The suction created by the impeller 44 draws air (arrow 64) in through inlet fitting 62, tube 63, into and through the space 24, and flows in the direction of arrows 58 through the filter 49, the opening 60 in the lid 16 bounded by the rim 54, and outwardly through the skirted portion 136 of housing 32, and out an exhaust fitting 61 formed integrally with the housing 32. As disclosed in the above mentioned U.S. Pat. No. 3,775,951, a float ball 67 is positioned in filter 49 so that it can float and cut off backflow by seating against the sleeve surrounding the opening 60 to cut off the vacuum. This feature is important where liquids are being vacuumed.

Suction is developed at an inlet fitting 62, which comprises an elbow formed integrally with the cover 16 and communicating between the ambient air and the canister space 24. Air enters the inlet fitting 62, passes downwardly through tube 63, and follows the path of arrows 64 into the space 24, follows arrow 58 through the filter 49, through opening 60, and out the exhaust fitting 61. The cover is designed with the intake tube 63 extending below the bottom of the filter. This directs all matter to the bottom of the tank thus extending the life of the filter itself. A flexible intake hose 66 is attached to the fitting 62 as shown in FIG. 1 and allows the suction forces to be directed by the operator where desired. The tube 63 is spin welded or otherwise secured to the lid in alignment with the inlet fitting 62. At the free end of the hose, a removable nozzle fitting 68 may be provided.

Another aspect of the invention is illustrated in FIGS. 1, 2, 5 and 7. According to this aspect of the invention, canister extensions 70 can be interposed between the canister 12 and the lid 16. By adding the extensions 70, the accumulation capacity of the canister can be increased to the extent desired, depending upon the number of extensions utilized. In FIG. 2, vacuum cleaner 10 is shown without any extensions. For example, the canister alone may have a capacity of approximately 6 gallons. The addition of one extension as in FIG. 5, may increase capacity on the order of three gallons for a total of nine gallons. FIG. 1 shows a canister 12 with two extensions 70 attached so that an exemplary capacity of twelve gallons is realized.

The extension 70 has an annular configuration to substantially match the cross section of the upper portion of the canister 12. The bottom edge 72 of the extension 70 has an annular lip 74 which bears on an annular lip 76 associated with the canister 12. As seen most clearly in FIG. 7, the lip 74 has an integral, annular groove 78 and radially outwardly therefrom a depending annular rib 80 having a squared cross-section. The lip 76 on the canister 12 has an annular, rounded rib 82 in alignment with the groove 78 and a stepped bore 84 in alignment with the rib 80 on the lip 74. Fusion between the lips can be accomplished by sonic welding or the like to effect a complete seal between extension 70 and canister 12.

The lid 16 is secured to the extension 70 in the same manner as the lid 16 is attached to the upper edge 14 of the canister 12. The upper edge 86 of the extension 70 is substantially the same in configuration as the upper edge 14 of the canister and has a lip 96. To removably maintain the connection between the upper edge 86 of the extension 70 and the lid 16, latches 88 are integrally formed with the lid at diametrically opposite positions thereon. If only two latches 88 are provided they would be diametrically opposite each other. If three or more latches are provided they will be equally spaced about the edge of the lid or cover 16. Separate carrying handles 89 are molded integrally with the exterior surface of the canister 12.

The lip 96 is held vertically captive between the underside 20 of the lid and an upwardly facing shoulder 92 associated with the depending portion 90. The shoulder 92 is guided into position against the underside 94 of the upper lip 96 on the extension 70 by a ramp surface 98. By exerting downward force upon the lid, the depending portion 90 deflects as the lip 96 encounters the ramp surface 98 and assumes its undeflected state when the shoulder 92 clears the lip 96. The lip 96 is closely captured, with the lid seated, between an annular depending rib 100 integrally formed with the lid 16 and a radially inwardly facing surface 102 of the depending portion 90. Shifting of the lid 16 relative to the extension 70 is thus prohibited without drawing outwardly against the depending portions 88 sufficiently to clear the shoulder 92 over the lip 96.

It can be seen that enlargement of the space 24 by the provision of extensions 70 can be readily accomplished. The extension 70 can be molded in the same manner as the canister. The canister can be stocked as a universal item and the capacity of the space 24 made either an exemplary six gallons or six plus a multiple of the number of extensions utilized times a representative capacity for that particular extension. The extensions can be molded in separate colors. The advantages in terms of inventory control are clearly apparent.

In order to accommodate the enlarged space 24 with one or more extensions, it is also advisable to increase the capacity of the evacuating structure associated with the housing 32 by changing the capacity of the rotor and/or the capacity of the motor. To accomplish low to high capacity conversion, the impeller 44' is removably attached to the motor shaft 42'. The impeller 44' operates in a chamber bounded vertically by the upper surface 104 of the lid and the underside of a metal plate 107 attached to the housing 32. Preferably, the chamber within which the impeller operates closely vertically bounds the impeller to maximize air movement and most efficiently evacuate the space 24. The evacuation capacity of the impeller can be increased by increasing the height of the vanes and increasing the height of the impeller area by inverting plate 107 which in turn increases the inlet area. In addition, the capacity of the motor 40' can be changed at the time that the impeller is changed to increase the evacuation capacity of the impeller.

The invention contemplates adapting the vertical height of the impeller chamber to accommodate different impellers. This is accomplished by configuring the plate 107 as shown in FIGS. 3, 5 and 6. The plate 107 has a flat body 108 with oppositely facing surfaces 110, 112. An annular rim 114 is concentric with the body 108, situated radially outwardly therefrom and is offset by cylindrical spacer ring 120 from the plane of the body 108. With the plate 107 in a first position as shown in FIG. 6, the rim 114 bears on the underside 116 of the housing 32 and is secured thereto as by screws 118. In the first position, the surface 110 faces downwardly and is spaced from the underside 116 of the housing by the height of the spacer ring 120 integrally connecting between the body 108 and the rim 114. A vertical height X is shown in FIG. 6 and represents the vertical dimension of the impeller chamber. This height X closely accommodates a low capacity impeller 44' and lower capacity motor, if desired.

By removing the screws 118, the plate 107 can be inverted from the FIG. 6 position so that the surface 112 of the body 108 faces downwardly. This second plate position is shown in FIG. 5. The rim 114 abuts the underside 116 of the housing in like fashion as in FIG. 6, however the ring 120 causes the body to vertically intersect the cavity 34. Accordingly, the height Y of the impeller chamber is increased over the height X of the corresponding chamber with the plate inverted as in FIG. 6. A larger capacity impeller 44 and/or a more powerful motor 40 can be installed. The position of the plate 107 is determined by the capacity of the canister and size of the motor required. The inclusion of extension 70 might warrant the inversion of the plate to the second position in FIG. 5 and the attachment of the larger capacity impeller 44 and/or large sized motor 40.

To facilitate interchange of the impellers for increasing the capacity of the cleaner, the housing 32 is separable from the lid 16 by removing screws extending through the lid and into threaded bores 124 formed in anchor protrusions 125 shown in FIG. 3. With the housing separated, the reduced diameter end 126 of the shaft 42' protrudes through the upper disc 46' of the impeller 44' as seen in FIG. 6. The end 126 is threaded to accept a nut 128, which secures the impeller 44'. The nut 128 draws the disc 46' against a spacing washer 130' abutting a shoulder 132 defined by an enlarged portion 134 of the shaft 42'. To accomplish the increasing of the capacity of the canister the impeller 44' is interchanged with impeller 44. At the same time the motor 40' may be changed for a higher capacity motor 40. The interchange involves merely separating the housing 32 from the lid, removing the nut 128, separating impeller 44' from the shaft, removing screws 118 from rim 114 to remove plate 107, unbolting and replacing motor 40', if desired, inverting plate 107 and securing it by screws 118 to the housing, substituting a different impeller 44 and reattaching the nut 126. The housing 32 can then be reassembled with the lid 16. The high capacity motor 40 is shifted vertically a distance Y-X to accommodate the plate inversion so that with either motor a spacer nut 160 seats on the plate surface facing away from the impeller. With conversion from the low to high capacity motor 40 and impeller 44, the motor shift is upwardly.

A further aspect of the invention is the simplification of the housing 32 and of the lid 16 by injection molding the housing as a single piece and the lid 16 as a separate single piece. The house 32 has a peripheral wall 36 about the cavity 34 which housing is a truncated cone with an enlarged base which joins with a horizontal outwardly extending wall 135 having a depending peripheral skirt 136. The wall 135 and skirt 136 are teardrop shaped with an exhaust fitting 61 integral with and transverse to the wall 135. The wall 135 and skirt 136 enclose the impeller cavity. An outturned rim 138 on skirt 136 enlarges the seating area 140 of the skirt which bears on the upper surface of the lid 16. Unitary molding obviates the need for separate parts to define the exhaust, impeller chamber and motor retaining cavity 34. The one piece molded lid 16 has many cost and part savings, such as, integrally molding the seal at the outer edge of the lid, integrally molding the filter sleeve 51 surrounding the opening 60, and the integrally molded inlet fitting 62 inlet tube 63 communicating with fitting 62 and outlet fitting 61.

The invention also contemplates mounting the motor 40 without an integral casing or housing. Rather, a cylindrical portion 142 extends into the cavity 34 and above the top wall 38 to define a cylindrical chamber 144 for close reception of the motor. Several sizes of motor can be accommodated by means of the chamber 144 being of a height as to permit different height, and therefore, different capacity, motors. As seen in FIG. 6, the upper edge 162 of the core of the axially shorter low capacity motor 40' still projects axially into the chamber 144 so that the motor 40' benefits completely from the draft created by fan blade 145 carried on the shaft 42. As the motor operates, the fan blade 145 draws ambient air through openings or vents 146 in the peripheral wall 36 through the chamber 144 and the portion 142 funnels air over the motor in cooling fashion. Air is exhausted through the chamber 144 at vents 148, which are shielded by an integral cover 150 so that foreign matter does not find its way through the vents 148 into the chamber 144. Applicant has found that the described mounting arrangement for the motor results in cooler operation than with a fully housed motor.

It should be understood that the foregoing detailed description was made for purposes of demonstrating the structure and operation of the invention with no unnecessary limitations to be understood therefrom.

I claim:

1. An improved vacuum cleaner of the type having a canister with a peripheral surface and defining a space therewithin for accumulation of matter, a removable lid for sealing the canister and having a downwardly facing surface, means for removably attaching the lid to the canister, means for evacuating air from the space within the canister, an inlet to admit matter into the space for accumulation therein and an outlet to exhaust air evacuated from the space, the improvement comprising:

said canister having an upper edge with a laterally projecting plastic lip defining an upwardly facing surface;

a first canister extension for connection to the canister to increase the space for accumulation of matter, said canister extension having a lower edge with a laterally projecting plastic lip defining a downwardly facing surface for engagement with the upwardly facing surface of the canister lip so that plastic-to-plastic engagement can be made between the canister and canister extension lips continuously about the peripheral surface of the canister;

said canister extension having an upper edge with a plastic lip having an upwardly facing surface;

means for connecting the lid selectively to the canister and canister extension so that the downwardly facing surface on the lid can be selectively engaged continuously about the periperal canister surface with the upwardly facing surface on the upper edge of the canister and the upwardly facing surface on the lip on the upper edge of the canister extension, said surface on the lip at the bottom edge of the canister extension being selectively engageable continuously about the peripheral canister surface with the surface on the lip on the upper edge of the canister and the surface of a lip on an upper edge of a second canister extension that is identical to the first canister extension, whereby the canister is universal in nature and can be usded selectively alone and in conjunction with at least one extension depending upon the desired accumulation capacity and the engaging lips on the canister and canister extension can be fused as by sonic welding to sealingly connect the canister and canister extension.

2. The improved vacuum cleaner of claim 1 wherein a motor is mounted in a housing, the means for evacuating the space comprises an impeller operatively connected to the motor and moving my chamber bounded by a surface associated with the lid and a plate on the housing.

3. The improved vacuum cleaner of claim 2 wherein means are provided on the housing to accommodate motors of different size and capacities to match the capacity of the canister.

4. An improved vacuum cleaner of the type having a canister with a space therewithin for accumulation of matter, a removable lid sealing the canister, means for evacuation air from the space within the canister, an inlet to admit matter into the space for accumulation therein and an outlet to exhaust air evacuated from the space, the improvement comprising:

a canister extension;

means for connecting the extension to the canister so that the space within the canister can be enlarged to increase accumulation capacity of the vacuum cleaner;

means for connecting the lid to the canister extension, whereby the canister is universal in nature and can be used selectively alone and in conjunction with the extension depending upon the desired accumulation capacity;

a housing;

a plate on the housing;

a motor mounted in the housing;

the means for evacuating the space comprising an impeller operatively connected to the motor and moving in a chamber bounded by a surface associated with the lid and the plate on the housing; and said plate has a substantially flat body with oppositely facing surfaces and a rim offset from the plane of the body and means connecting the rim to the housing with the plate selectively in either a first position wherein one of the oppositely facing surfaces of the plate bounds the chamber or a second position wherein the other of the oppositely facing surfaces of the plate bounds the chamber and the spacing between the other plate surface is greater than the spacing between the one plate surface and the lid surface with the plate in the first position, whereby with the plate in said second position a larger capacity impeller can be used.

5. The improved vacuum cleaner of claim 4, wherein said rim is integrally connected to said body by a cylindrical ring having an axis coinciding with the axis of the impeller.

6. The improved vacuum of claim 5 wherein said housing permits motors of different capacities to be substituted when impellers of different capacities are selected.

* * * * *